US007216567B1

(12) United States Patent
Nelson

(10) Patent No.: US 7,216,567 B1
(45) Date of Patent: May 15, 2007

(54) MATERIAL REMOVING APPARATUS

(76) Inventor: Bradley A. Nelson, 11 Marsten La., Unit 34, Enfield, NH (US) 03748

( * ) Notice: Subject to any disclaimer, the term of this patent is extended or adjusted under 35 U.S.C. 154(b) by 282 days.

(21) Appl. No.: 10/963,496

(22) Filed: Oct. 13, 2004

(51) Int. Cl.
*E04D 15/00* (2006.01)

(52) U.S. Cl. ..... 81/45; 30/169; 30/170

(58) Field of Classification Search ..... 81/45; 30/169, 170
See application file for complete search history.

(56) References Cited

U.S. PATENT DOCUMENTS 4,691,439 A 9/1987 Marra
4,699,430 A 10/1987 Nichols
4,709,479 A * 12/1987 Lavelette ..... 30/170
4,858,503 A 8/1989 Dike, Jr.
D324,633 S 3/1992 Weinrich
5,741,047 A 4/1998 Ordonez
6,105,470 A 8/2000 Hutchins
6,116,117 A * 9/2000 Nicolosi et al. ..... 81/45

* cited by examiner

*Primary Examiner*—Joseph J. Hail, III
*Assistant Examiner*—Shantese McDonald

(57) ABSTRACT

A material removing apparatus includes a frame including a planar base portion and axially spaced front and rear portions. An elongated axle and a plurality of wheels are attached thereto and a plurality of rigid brackets are secured to the axle adjacent to the wheels. A contoured handle is securely mounted to the frame. The apparatus also includes a lifting plate extending forwardly from the bracket end portions and spaced forwardly from the wheels for lifting shingles upwardly and away from a support surface. The plate includes an inner shaft having opposed end portions for defining a fulcrum axis and an outer shaft journaled about the inner shaft and rotatable about the fulcrum axis in clockwise and counterclockwise directions. A mechanism is included for pivoting the plate about a selected arcuate path so that an operator can position the plate between the support surface and the shingles.

15 Claims, 5 Drawing Sheets

MATERIAL REMOVING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a material removing apparatus and, more particularly, to a material removing apparatus for removing fastened shingles from a support surface.

2. Prior Art

It is a common practice to use hand tools on the order of pry bars and shovels for the removal of shingles. It is noted that numerous patents disclose portable, reciprocating roof shingle removing structures. One example is a gasoline operated structure utilizing reciprocating blade members to be placed underneath the roofing shingles to be removed by utilizing an agitating and generally reciprocating type movement. This method, however, can result in damage caused to the underlying support surface of the shingles and the gasoline used to power it is not cost-effective.

Another patent discloses a rather elaborate structure utilized for a continuous shingle removing process which is rather bulky and complex compared to other devices of similar design, thus making it inconvenient for use at elevated positions. Yet another patent discloses an electrically operated shingle stripping apparatus with blades thereon to remove materials utilizing a reciprocating movement. Such an apparatus possesses the same problem as the reciprocating apparatus mentioned above and poses a new problem by having to cope with an electrical wire while working.

Accordingly, a need remains for a material removing apparatus in order to overcome the above-noted shortcomings. The present invention satisfies such a need by providing an apparatus that is relatively light weight, easy to use, structurally strong, results in time savings through its use and is reasonably priced. Such an apparatus advantageously allows both roofing contractors and do-it-yourself homeowners to remove shingles without the need of a flat shovel, as is the current tool of choice.

BRIEF SUMMARY OF THE INVENTION

In view of the foregoing background, it is therefore an object of the present invention to provide a material removing apparatus. These and other objects, features, and advantages of the invention are provided by an apparatus for removing fastened shingles from a support surface.

The apparatus includes a frame sized and shaped for being pushed along a selected surface. Such a frame includes a substantially planar base portion that has a substantially rectangular shape and is provided with a centrally disposed longitudinal axis extending parallel to a direction of travel. The base section further has axially spaced front and rear portions disposed along a partial length of the apparatus. An elongated axle and a plurality of wheels are rotatably attached thereto wherein the wheels are oppositely positioned from the axis and equidistantly disposed therefrom.

A plurality of rigid brackets having opposed end portions are secured to the axle adjacent to the wheels. Such brackets extend forwardly therefrom along a selected plane situated substantially parallel to the axis.

A handle and an associated mounting bracket are included for securing the handle to the frame adjacent to the axle. Such a handle extends upwardly and rearwardly from the plate so that an operator can effectively control the direction of travel while standing rearwardly of the frame. The handle has a contoured rear portion for advantageously providing an area along which the operator can maintain an effective grip during operating conditions.

The apparatus further includes a lifting plate formed from hardened material extending forwardly from selected ones of the bracket end portions and spaced forwardly from the wheels. The lifting plate preferably includes a serrated edge provided with a plurality of teeth for advantageously engaging nails embedded through the shingles and the support surface. Such a plate is adjustably positionable medially of the shingles and the support surface for conveniently lifting the shingles upwardly and away from the support surface.

The plate includes an inner shaft having opposed end portions secured to the selected end portions of the axle and for defining a fulcrum axis therebetween. The inner shaft preferably extends substantially parallel to the axle and includes a plurality of bearings operably attached to the end portions thereof. Such an inner shaft is maintained at a substantially stationary position during operating conditions.

The plate further includes an outer shaft journaled about the inner shaft and rotatable about the fulcrum axis in clockwise and counter clockwise directions. The lifting plate has a substantially planar top surface for conveniently receiving and collecting the shingles thereon.

A mechanism is included for pivoting the plate about a selected arcuate path so that an operator can effectively position the plate between the support surface and the shingles during operating conditions. The pivoting mechanism preferably includes an elongated shaft that has a first end portion operably attached to a selected portion of the outer shaft and further has a second end portion extending rearwardly therefrom along a predetermined plane obliquely offset from the axis. The mechanism also includes a hydraulic cylinder including a piston adaptable between extended and retracted positions and operably connected to the second shaft end portion. Such a hydraulic cylinder further includes an air supply source externally connected thereto wherein the hydraulic cylinder cooperates with the shaft for causing the plate to pivot along the arcuate path as the piston is extended and retracted along a linear path.

Preferably, an elongated support member having a threaded outer surface is adjustably securable to the rear frame portion. Such a support member has opposed end portions aligned along a substantially vertical axis and is engageable with a ground surface and the frame respectively so that a spatial relationship therebetween can be manually adjusted by the operator. The support member further includes an end cap attached to one of the end portions thereof for advantageously assisting the plate to pivot about the fulcrum axis during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
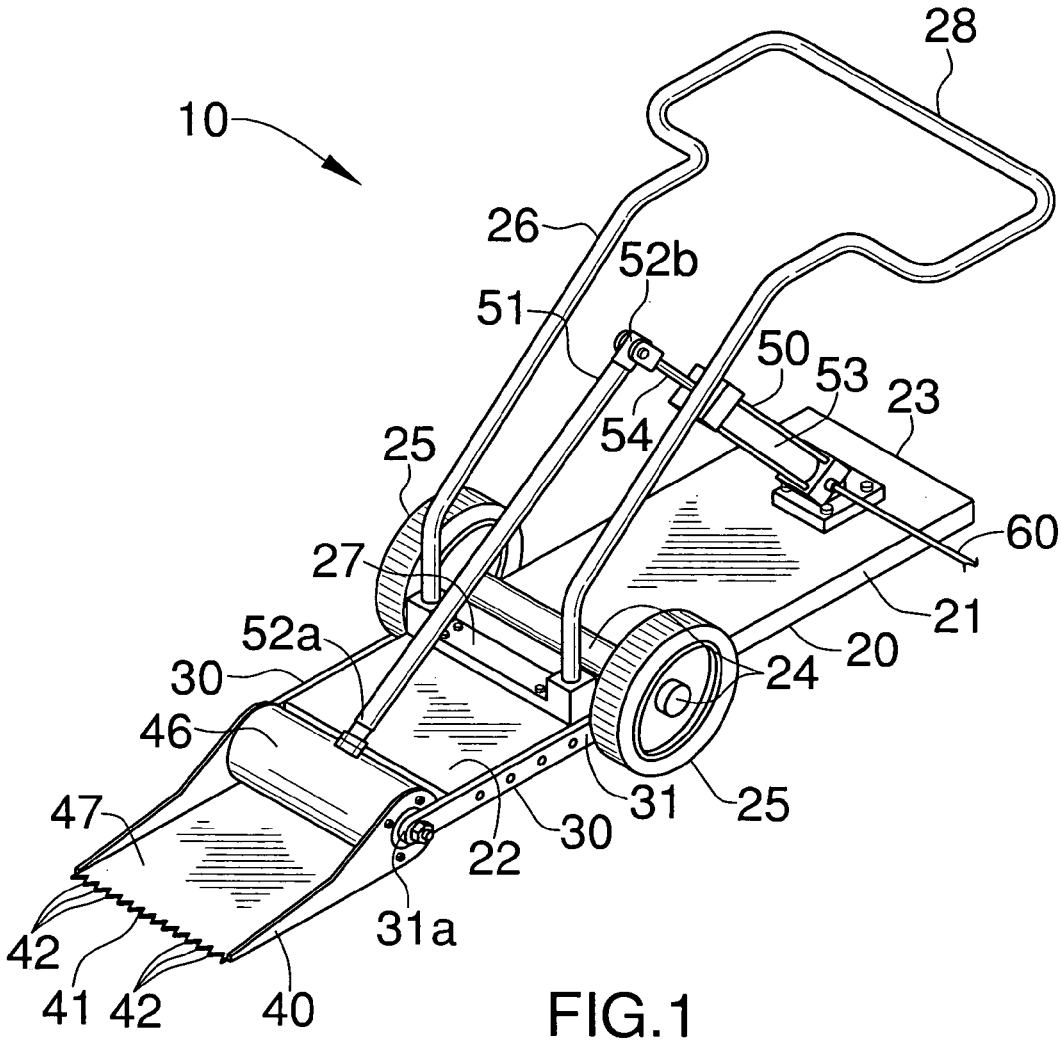
FIG. 1 is a perspective view showing an apparatus for removing roof material, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–6 by the reference numeral 10 and is intended to provide a material removing apparatus. It should be understood that the apparatus 10 may be used to remove many different types of material and should not be limited to removing only roof shingles.

Referring initially to FIG. 1, the apparatus 10 includes a frame 20 sized and shaped for being pushed along a selected surface. Such a frame 20 includes a substantially planar base portion 21 that has a substantially rectangular shape and is provided with a centrally disposed longitudinal axis extending parallel to a direction of travel. The base section 21 further has axially spaced front 22 and rear 23 portions disposed along a partial length of the apparatus 10. An elongated axle 24 and a plurality of wheels 25 are rotatably attached thereto wherein the wheels 25 are oppositely positioned from the axis and equidistantly disposed therefrom. Such wheels 25 advantageously allow the apparatus 10 to be pushed along the support surface with much less effort than would be necessary in the absence of the wheels 25.

Figure 3:
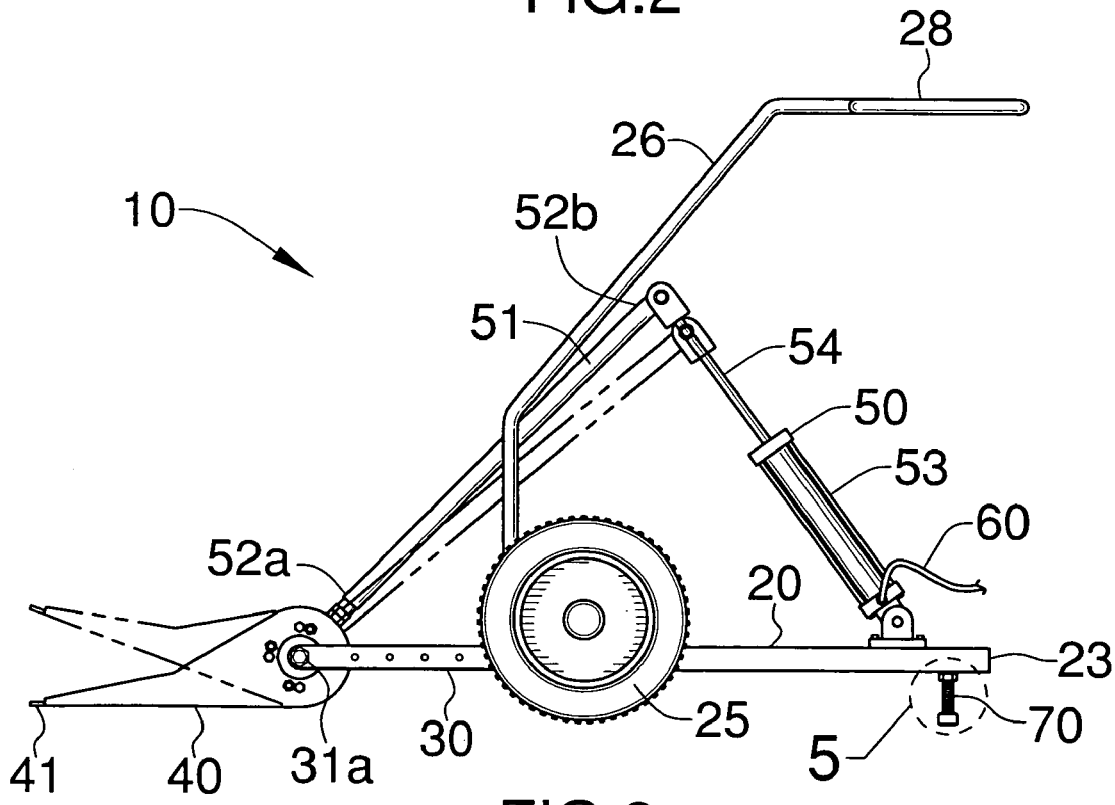
FIG. 3 is a side elevational view of the apparatus shown in FIG. 1, showing the pivotal movement of the plate.
Figure 4:
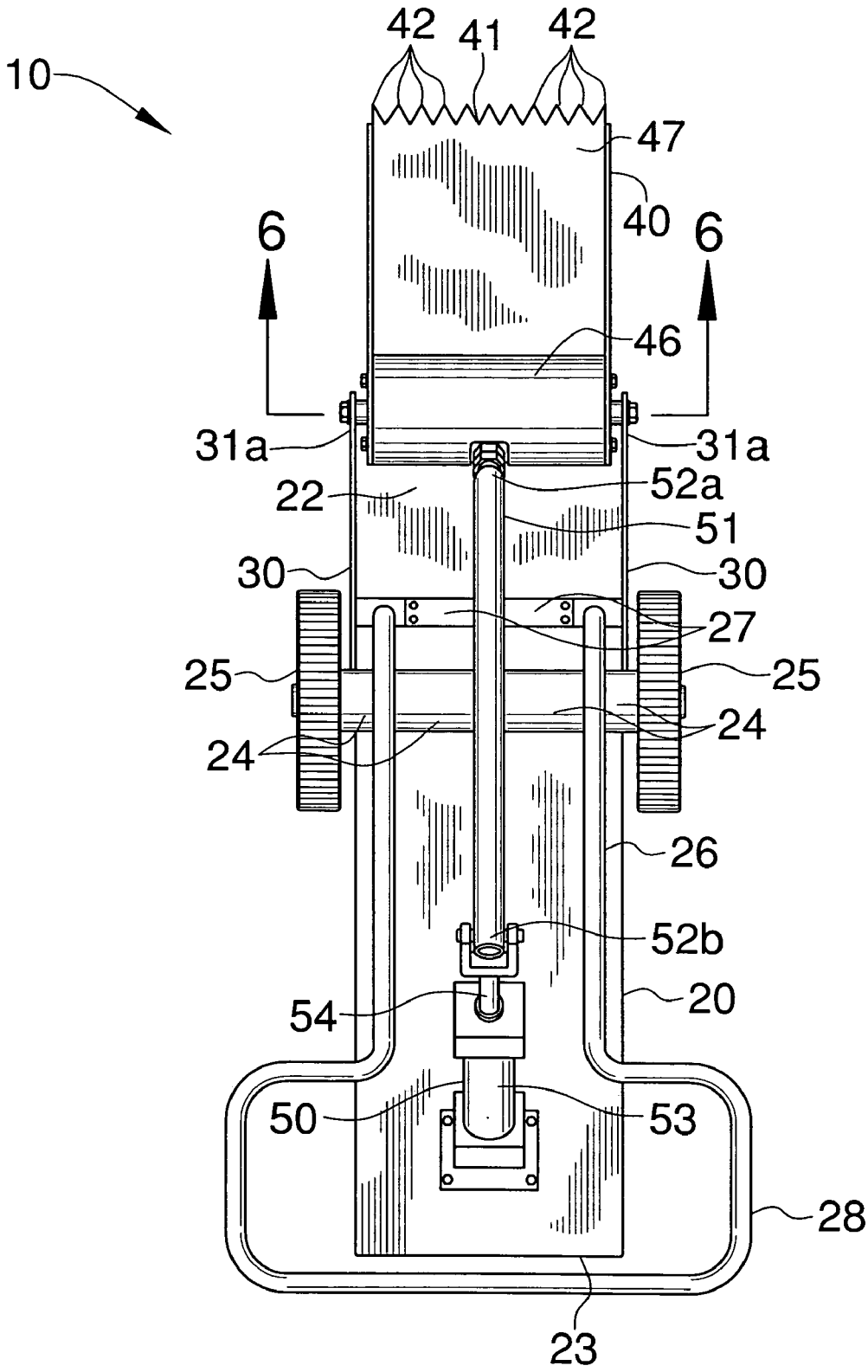
FIG. 4 is a top plan view of the apparatus shown in FIG. 1.

Referring to FIGS. 1, 3 and 4, a plurality of rigid brackets 30 having opposed end portions 31 are secured to the axle 24 adjacent to the wheels 25. Such brackets 30 extend forwardly therefrom along a selected plane situated substantially parallel to the axis.

Still referring to FIGS. 1, 3 and 4, a handle 26 and an associated mounting bracket 27 are included for securing the handle 26 to the frame 20 adjacent to the axle 24. Such a handle 26 extends upwardly and rearwardly from the plate 40 (described herein below) so that an operator can effectively control the direction of travel while standing rearwardly of the frame 20. The handle 26 has a contoured rear portion 28 for advantageously providing an area along which the operator can maintain an effective grip during operating conditions, thus allowing the operator to easily manipulate the apparatus 10 as they wish.

Figure 2:
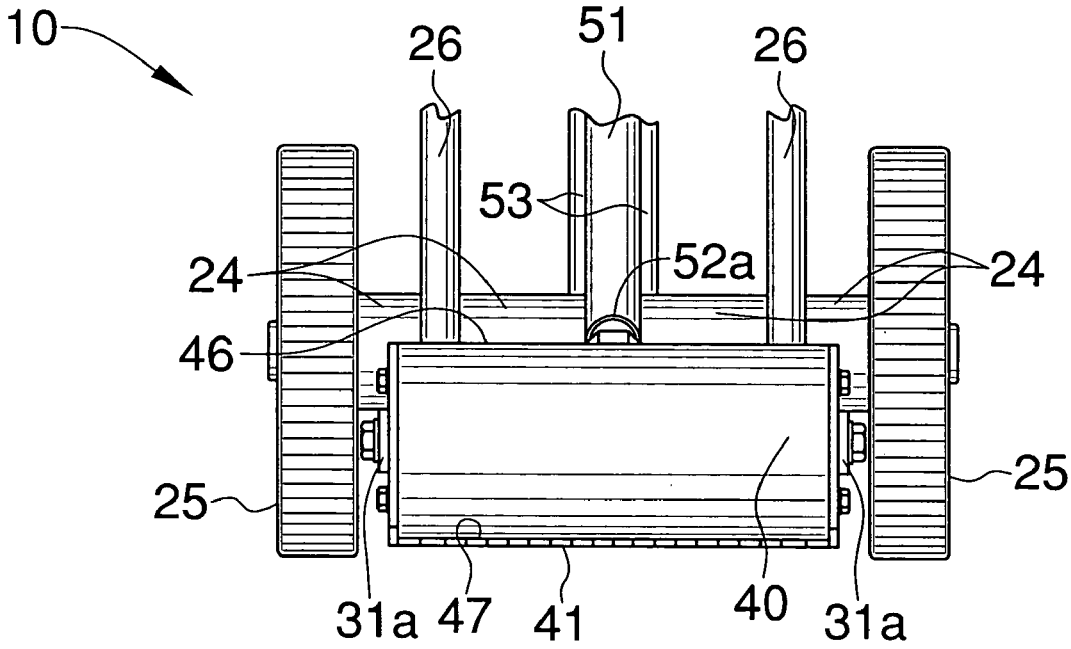
FIG. 2 is a front elevational view of the apparatus shown in FIG. 1.

Referring to FIGS. 1, 2 and 4, the apparatus 10 further includes a lifting plate 40 formed from hardened material extending forwardly from selected ones of the bracket end portions 31*a* and spaced forwardly from the wheels 25. The lifting plate 40 includes a serrated edge 41 provided with a plurality of teeth 42 for advantageously engaging nails embedded through the shingles and the support surface, thus eliminating the task of having to remove each nail manually after the shingles have been removed. This feature saves the user a considerable amount of time and energy that can be used for more productive tasks. Such a plate 40 is adjustably positionable medially of the shingles and the support surface for conveniently lifting the shingles upwardly and away from the support surface.

Figure 6:
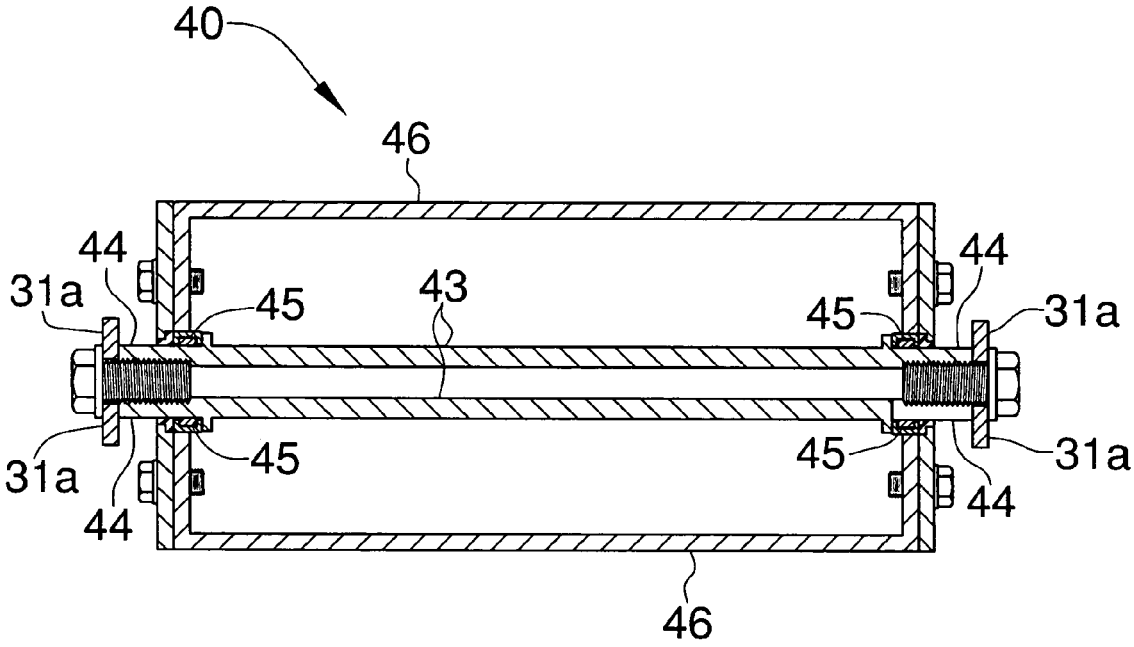
FIG. 6 is a cross-sectional view of the apparatus shown in FIG. 4, taken along line 6—6.

Referring to FIG. 6, the plate 40 includes an inner shaft 43 having opposed end portions 44 secured to the selected end portions of the axle 24 and for defining a fulcrum axis therebetween. The inner shaft 43 extends substantially parallel to the axle 24 and includes a plurality of bearings 45 operably attached to the end portions 44 thereof. Such an inner shaft 43 is maintained at a substantially stationary position during operating conditions.

Still referring to FIG. 6, the plate 40 further includes an outer shaft 46 journaled about the inner shaft 43 and rotatable about the fulcrum axis in clockwise and counterclockwise directions. The lifting plate 40 has a substantially planar top surface 47 for conveniently receiving and directing shingles thereon so that the shingles can be rolled away depending on the roof pitch.

Referring to FIGS. 1, 3 and 4, a mechanism 50 is included for pivoting the plate 40 about a selected arcuate path so that an operator can effectively position the plate 40 between the support surface and the shingles during operating conditions. The pivoting mechanism 50 includes an elongated shaft 51 that has a first end portion 52*a* operably attached to a selected portion of the outer shaft 46 and further has a second end portion 52*b* extending rearwardly therefrom along a predetermined plane obliquely offset from the axis. The mechanism 50 also includes a hydraulic cylinder 53 including a piston 54 adaptable between extended and retracted positions and operably connected to the second shaft end portion 52*b*. Such a hydraulic cylinder 53 further includes an air supply source 60 externally connected thereto wherein the hydraulic cylinder 53 cooperates with the shaft 51 for causing the plate 40 to pivot along the arcuate path as the piston 54 is extended and retracted along a linear path.

Figure 5:
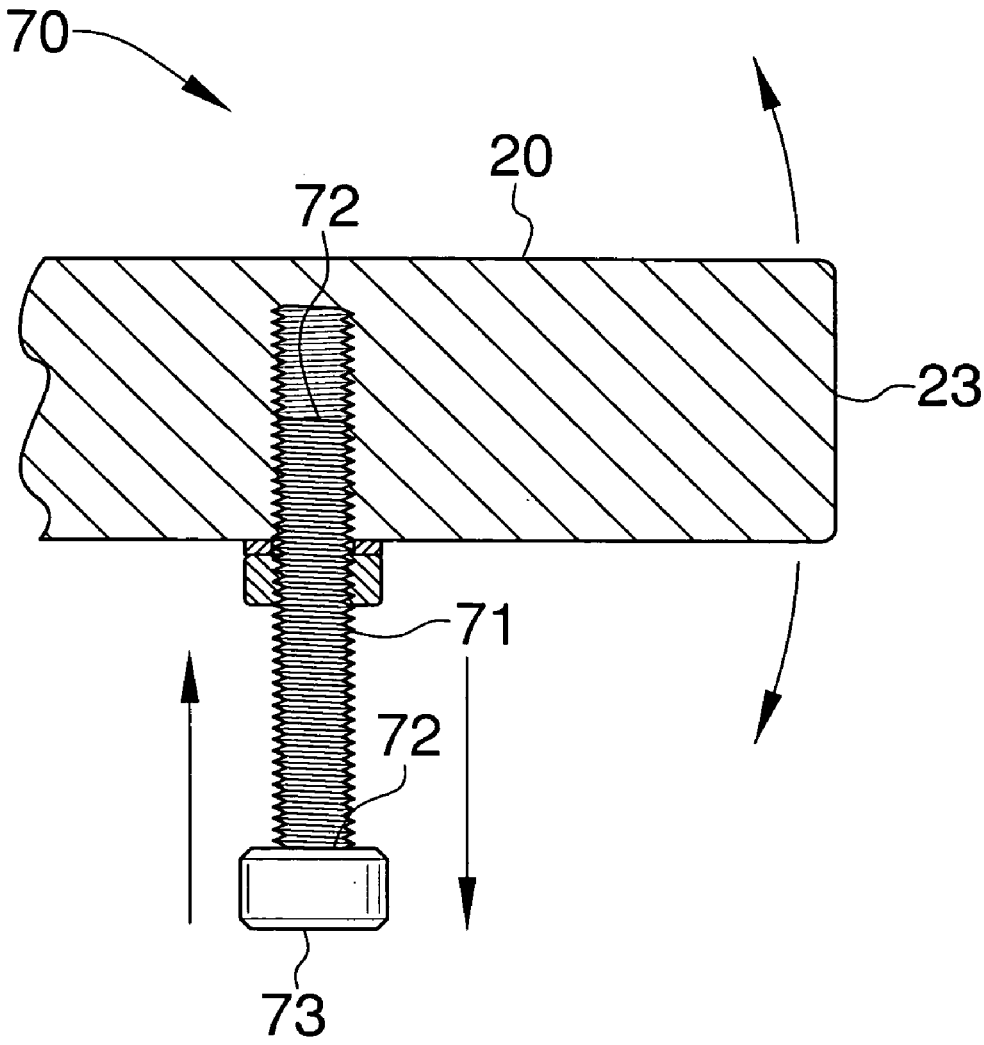
FIG. 5 is a cross-sectional view of the bolt shown in FIG. 3, taken along line 5—5.

Referring to FIGS. 3 and 5, an elongated support member 70 having a threaded outer surface 71 is adjustably securable to the rear frame portion 23. Such a support member 70 has opposed end portions 72 aligned along a substantially vertical axis and is engageable with a ground surface and the frame 20 respectively such that a spatial relationship therebetween can be manually adjusted by the operator as the needs for a particular support surface may require. The support member 70 further includes an end cap 73 attached to one of the end portions 72*a* thereof for advantageously assisting the plate 40 to pivot about the fulcrum axis during operating conditions by providing a counter force to the force applied by the pivot mechanism 50 onto the plate 40.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for removing fastened shingles from a support surface, said apparatus comprising:

a frame sized and shaped for being pushed along a selected surface, said frame comprising a substantially planar base portion having a centrally disposed longitudinal axis extending parallel to a direction of travel, said base section further having axially spaced front and rear portions disposed along a partial length of said apparatus, an elongated axle and a plurality of wheels rotatably attached thereto wherein said wheels are oppositely positioned from the axis and equidistantly disposed therefrom, and a plurality of brackets having opposed end portions secured to said axle and adjacent said wheels, said brackets extending forwardly therefrom along a selected plane situated substantially parallel to the axis, and a handle and an associated mounting bracket for securing said handle to said frame and adjacent said axle, said handle extending upwardly and rearwardly from said plate so that an operator can effectively control the direction of travel while standing rearwardly of said frame;

a lifting plate extending forwardly from selected ones of said brackets and spaced forwardly from said wheels, said plate being adjustably positionable medially of the shingles and the support surface for lifting the shingles upwardly and away from the support surface, said plate including an inner shaft having opposed end portions secured to said selected end portions of said brackets and for defining a fulcrum axis therebetween, said plate further including an outer shaft journaled about said inner shaft and being rotatable about the fulcrum axis in clockwise and counter clockwise directions; and means for pivoting said plate about a selected arcuate path so that an operator can effectively position said plate between the support surface and the shingles during operating conditions.

2. The apparatus of claim 1, wherein said pivoting means comprises:

an elongated shaft having a first end portion operably attached to a selected portion of said outer shaft and further having a second end portion extending rearwardly therefrom along a predetermined plane obliquely offset from the axis; and a hydraulic cylinder including a piston adaptable between extended and retracted positions and being operably connected to said second shaft end portion, said hydraulic cylinder further including an air supply source externally connected thereto;

wherein said hydraulic cylinder cooperates with said shaft for causing said plate to pivot along the arcuate path as said piston is extended and retracted along a linear path.

3. The apparatus of claim 2, wherein said inner shaft extends substantially parallel to said axle and includes a plurality of bearings operably attached to end portions of said axle respectively, said inner shaft being maintained at a substantially stationary position during operating conditions.

4. The apparatus of claim 1, further comprising:

an elongated support member having a threaded outer surface and being adjustably securable to said rear frame portion, said support member having opposed end portions aligned along a substantially vertical axis and being engageable with a ground surface and said frame respectively such that a spatial relationship therebetween can be manually adjusted by the operator, said support member further including an end cap attached to one said end portions thereof for assisting said plate to pivot about the fulcrum axis during operating conditions.

5. The apparatus of claim 1, wherein said lifting plate includes a serrated edge provided with a plurality of teeth for engaging nails embedded through the shingles and the support surface.

6. An apparatus for removing fastened shingles from a support surface, said apparatus comprising:

a frame sized and shaped for being pushed along a selected surface, said frame comprising a substantially planar base portion having a substantially rectangular shape and being provided with a centrally disposed longitudinal axis extending parallel to a direction of travel, said base section further having axially spaced front and rear portions disposed along a partial length of said apparatus, an elongated axle and a plurality of wheels rotatably attached thereto wherein said wheels are oppositely positioned from the axis and equidistantly disposed therefrom, and a plurality of rigid brackets having opposed end portions secured to said axle and adjacent said wheels, said brackets extending forwardly therefrom along a selected plane situated substantially parallel to the axis, and a handle and an associated mounting bracket for securing said handle to said frame and adjacent said axle, said handle extending upwardly and rearwardly from said plate so that an operator can effectively control the direction of travel while standing rearwardly of said frame;

a lifting plate formed from hardened material and extending forwardly from selected ones of said brackets and spaced forwardly from said wheels, said plate being adjustably positionable medially of the shingles and the support surface for lifting the shingles upwardly and away from the support surface, said plate including an inner shaft having opposed end portions secured to said selected end portions of said brackets and for defining a fulcrum axis therebetween, said plate further including an outer shaft journaled about said inner shaft and being rotatable about the fulcrum axis in clockwise and counter clockwise directions; and means for pivoting said plate about a selected arcuate path so that an operator can effectively position said plate between the support surface and the shingles during operating conditions.

7. The apparatus of claim 6, wherein said pivoting means comprises:

an elongated shaft having a first end portion operably attached to a selected portion of said outer shaft and further having a second end portion extending rearwardly therefrom along a predetermined plane obliquely offset from the axis; and a hydraulic cylinder including a piston adaptable between extended and retracted positions and being operably connected to said second shaft end portion, said hydraulic cylinder further including an air supply source externally connected thereto;

wherein said hydraulic cylinder cooperates with said shaft for causing said plate to pivot along the arcuate path as said piston is extended and retracted along a linear path.

8. The apparatus of claim 7, wherein said inner shaft extends substantially parallel to said axle and includes a plurality of bearings operably attached to end portions of said axle respectively, said inner shaft being maintained at a substantially stationary position during operating conditions.

9. The apparatus of claim 6, further comprising:

an elongated support member having a threaded outer surface and being adjustably securable to said rear frame portion, said support member having opposed end portions aligned along a substantially vertical axis and being engageable with a ground surface and said frame respectively such that a spatial relationship therebetween can be manually adjusted by the operator, said support member further including an end cap attached to one said end portions thereof for assisting said plate to pivot about the fulcrum axis during operating conditions.

10. The apparatus of claim 6, wherein said lifting plate includes a serrated edge provided with a plurality of teeth for engaging nails embedded through the shingles and the support surface.

11. An apparatus for removing fastened shingles from a support surface, said apparatus comprising:

a frame sized and shaped for being pushed along a selected surface, said frame comprising a substantially planar base portion having a substantially rectangular shape and being provided with a centrally disposed longitudinal axis extending parallel to a direction of travel, said base section further having axially spaced front and rear portions disposed along a partial length of said apparatus, an elongated axle and a plurality of wheels rotatably attached thereto wherein said wheels are oppositely positioned from the axis and equidistantly disposed therefrom, and a plurality of rigid brackets having opposed end portions secured to said axle and adjacent said wheels, said brackets extending forwardly therefrom along a selected plane situated substantially parallel to the axis, and a handle and an associated mounting bracket for securing said handle to said frame and adjacent said axle, said handle extending upwardly and rearwardly from said plate so that an operator can effectively control the direction of travel while standing rearwardly of said frame, said handle having a contoured rear portion for providing an area along which the operator can maintain an effective grip during operating conditions;

a lifting plate formed from hardened material and extending forwardly from selected ones of said bracket and spaced forwardly from said wheels, said plate being adjustably positionable medially of the shingles and the support surface for lifting the shingles upwardly and away from the support surface, said plate including an inner shaft having opposed end portions secured to said selected end portions of said brackets and for defining a fulcrum axis therebetween, said plate further including an outer shaft journaled about said inner shaft and being rotatable about the fulcrum axis in clockwise and counter clockwise directions, said lifting plate having a substantially planar top surface for receiving and collecting the shingles thereon; and means for pivoting said plate about a selected arcuate path so that an operator can effectively position said plate between the support surface and the shingles during operating conditions.

12. The apparatus of claim 11, wherein said pivoting means comprises:

an elongated shaft having a first end portion operably attached to a selected portion of said outer shaft and further having a second end portion extending rearwardly therefrom along a predetermined plane obliquely offset from the axis; and a hydraulic cylinder including a piston adaptable between extended and retracted positions and being operably connected to said second shaft end portion, said hydraulic cylinder further including an air supply source externally connected thereto;

wherein said hydraulic cylinder cooperates with said shaft for causing said plate to pivot along the arcuate path as said piston is extended and retracted along a linear path.

13. The apparatus of claim 12, wherein said inner shaft extends substantially parallel to said axle and includes a plurality of bearings operably attached to and portions of said axle respectively, said inner shaft being maintained at a substantially stationary position during operating conditions.

14. The apparatus of claim 11, further comprising:

an elongated support member having a threaded outer surface and being adjustably securable to said rear frame portion, said support member having opposed end portions aligned along a substantially vertical axis and being engageable with a ground surface and said frame respectively such that a spatial relationship therebetween can be manually adjusted by the operator, said support member further including an end cap attached to one said end portions thereof for assisting said plate to pivot about the fulcrum axis during operating conditions.

15. The apparatus of claim 11, wherein said lifting plate includes a serrated edge provided with a plurality of teeth for engaging nails embedded through the shingles and the support surface.

* * * * *